United States Patent [19]

Ikeda et al.

[11] Patent Number: 4,781,540

[45] Date of Patent: Nov. 1, 1988

[54] PISTON TYPE COMPRESSOR FOR AIR CONDITIONING UNIT HAVING ASYMMETRIC VALVE MECHANISM

[75] Inventors: Hayato Ikeda; Mitsuhiro Oiwa; Satoshi Kitahama; Hiroshi Onomura; Masahiro Sawada, all of Kariya, Japan

[73] Assignee: Kabushiki Kaisha Toyoda Jidoshokki Seisakusho, Aichi, Japan

[21] Appl. No.: 937,340

[22] Filed: Dec. 3, 1986

[30] Foreign Application Priority Data

Dec. 5, 1985 [JP] Japan ..... 60-274108
Dec. 27, 1985 [JP] Japan ..... 60-299265

[51] Int. Cl.[4] ..... F04B 27/08; F04B 39/10; F16K 15/16

[52] U.S. Cl. ..... 417/269; 417/571; 137/855

[58] Field of Search ..... 417/269, 559, 569, 571; 137/855, 856

[56] References Cited

U.S. PATENT DOCUMENTS 2,559,067 7/1951 Doeg ..... 417/571 X
2,913,168 11/1959 Heidorn ..... 417/269
4,283,166 8/1981 Hiraga ..... 417/269
4,642,037 2/1987 Fritchman ..... 137/856 X

FOREIGN PATENT DOCUMENTS 97974 6/1982 Japan ..... 417/269
113278 6/1984 Japan ..... 417/269

*Primary Examiner*—Paul F. Neils
*Attorney, Agent, or Firm*—Burgess, Ryan and Wayne

[57] ABSTRACT

A piston type compressor having a cylinder block in which a plurality of compression chambers permitting a plurality of pistons to be reciprocated so as to compress a refrigerant gas pumped from a suction chamber formed in an end housing into the compression chambers through suction ports of a valve plate, openably closed by a suction valve mechanism with a plurality of suction reed valves, and to discharge the compressed refrigerant gas from the compression chambers into a discharge chamber formed in the end housing through discharge ports of the valve plate, are openably closed by a discharge valve mechanism having a plurality of discharge reed valves. The suction and discharge reed valves of the suction and discharge valve mechanisms are prevented from undergoing complicated and irregular vibrations by an asymmetrical arrangement of the suction and discharge ports of the valve plate, or by provision of asymmetrical through-openings to adjust mechanical flexibility to the suction and discharge reed valves for both reed valves.

11 Claims, 5 Drawing Sheets

PISTON TYPE COMPRESSOR FOR AIR CONDITIONING UNIT HAVING ASYMMETRIC VALVE MECHANISM

BACKGROUND OF THE INVENTION

1. Field of the Invention

The present invention relates to a piston type compressor with an improved valve mechanism, adapted for use in a unit for air-conditioning a vehicle passenger compartment, and more particularly, to a piston type compressor with suction and discharge valve mechanisms free from irregular vibrations which cause noise in the air-conditioning circuit and abnormal resonances in the vehicle 2. Description of the Related Art Many piston type compressors, such as a swash plate type compressor and a wobble plate type compressor, are known. For example, U.S. Pat. No. 4,403,921 to Kato et al discloses a swash plate type compressor with double-acting reciprocatory pistons and suction and discharge valve mechanisms employing suction and discharge reed valves. The known swash plate type compressor of U.S. Pat. No. 4,403,921 includes a cylinder block having therein a plurality of cylinder bores serving as compression chambers for permitting double-acting pistons to be reciprocated therein to compress a refrigerant gas. The ends of the cylinder block are closed by front and rear housings, via valve plates, respectively, so that suction and discharge chambers are formed in each of the front and rear housings. The suction chambers are fluidly communicated with the compression chambers through suction ports formed in the valve plates and suction reed valves arranged on inner side of respective valve plates, and the discharge chambers are fluidly communicated with the compression chambers through discharge ports formed in the same valve plates and discharge reed valves arranged on an outer side of respective valve plates. The valve plates are also formed with inlet ports for permitting a refrigerant gas returning from the outer air-conditioning circuit to flow into the suction chambers, and outlet ports for permitting a compressed refrigerant gas to flow from the discharge chambers into the air-conditioning circuit.

With the above-described swash plate operated piston type compressor, the movement of the suction and discharge reed valves from the open position thereof apart from the valve plates to the closed position thereof in close contact with the valve plates, and vice versa, takes place in response to a pressure differential between the suction and discharge chambers and the compression chambers of the plurality of cylinder bores. Therefore, a change in the amount of the refrigerant gas throughout the air-conditioning circuit including the compressor, as well as a change in a flow resistance of the gas pumped into the compression chambers from the suction chambers and discharged from the compression chambers into the discharge chambers during operation of the compressor, causes an abnormal vibration of the suction and discharge reed valves. The abnormal vibration of the valves is added to the normal oscillatory motions of the same valves, and as a result, complicated and irregular vibrations of the suction and discharge reed valves occur. The complicated vibrations are transmitted to an evaporator and a gas condenser in the air-conditioning circuit, via a suction gas piping and a discharge gas piping, and cause noise from the evaporator and the gas condenser.

Further, in recent light-weight cars, the body of the car per se is brought into a state of resonance with the vibrating evaporator and the condenser, and produces a resonant noise in the passenger compartment of the car.

SUMMARY OF THE INVENTION

An object of the present invention is to eliminate the above-mentioned defects encountered by the conventional piston type compressor with suction and discharge reed valves.

Another object of the present invention is to provide an improved valve mechanism capable of preventing suction and discharge reed valves of a piston type compressor from being subjected to complicated and irregular vibrations which cause noise in the air-conditioning circuit incorporating the compressor.

A further object of the present invention is to provide a piston type compressor adapted to be used for forming a quiet air-conditioning system capable of being mounted on light weight vehicles.

In accordance with the present invention, there is provided a piston type compressor which includes: a cylinder block having therein a plurality of axial cylinder bores formed as compression chambers for permitting pistons to be reciprocated therein to compress a refrigerant gas; at least a housing closing an axial end of the cylinder block for forming a suction chamber receiving therein a refrigerant gas to be compressed and a discharge chamber for receiving a compressed refrigerant gas; a valve plate having an inlet port for introducing the refrigerant gas to be compressed from an outer air-conditioning circuit into the suction chamber, a suction port for fluidly communicating between the suction chamber and the compression chambers, an outlet port for discharging the compressed refrigerant gas from the discharging chamber toward the outer air-conditioning circuit, and a discharge port for fluidly communicating between the discharge chamber and the compression chambers; suction valve means arranged on one end face of the valve plate and having a plurality of suction reed valves adapted to perform an oscillatory movement between a closing position when in contact with the valve plate for closing the suction port and an opening position apart from the valve plate for opening the suction port in response to a reciprocating motion of the pistons, each suction reed valve having a substantial length to define first and second symmetrical planar portions on both sides of a lengthwise central axis thereof; discharge valve means arranged on the other end face of the valve plate and having a plurality of discharge reed valves adapted to perform an oscillatory movement between a closing position when in contact with the valve plate for closing the discharge port and an opening position apart from the valve plate for opening the discharge port in response to a reciprocating motion of the pistons, each discharge reed valve having a substantial length to define first and second symmetrical planar portions on both sides of a lengthwise central axis thereof; and, means for subjecting a predetermined one of the first and second planar portions of each of at least either one of the plurality of suction and discharge reed valves to a larger displacement from the closing position upon each movement toward the opening position.

BRIEF DESCRIPTION OF THE DRAWINGS

The above and other objects, features and advantages of the present invention will become apparent from the ensuing description of the embodiments illustrated in the accompanying drawings wherein.

DESCRIPTION OF THE PREFERRED EMBODIMENTS

Figure 1:
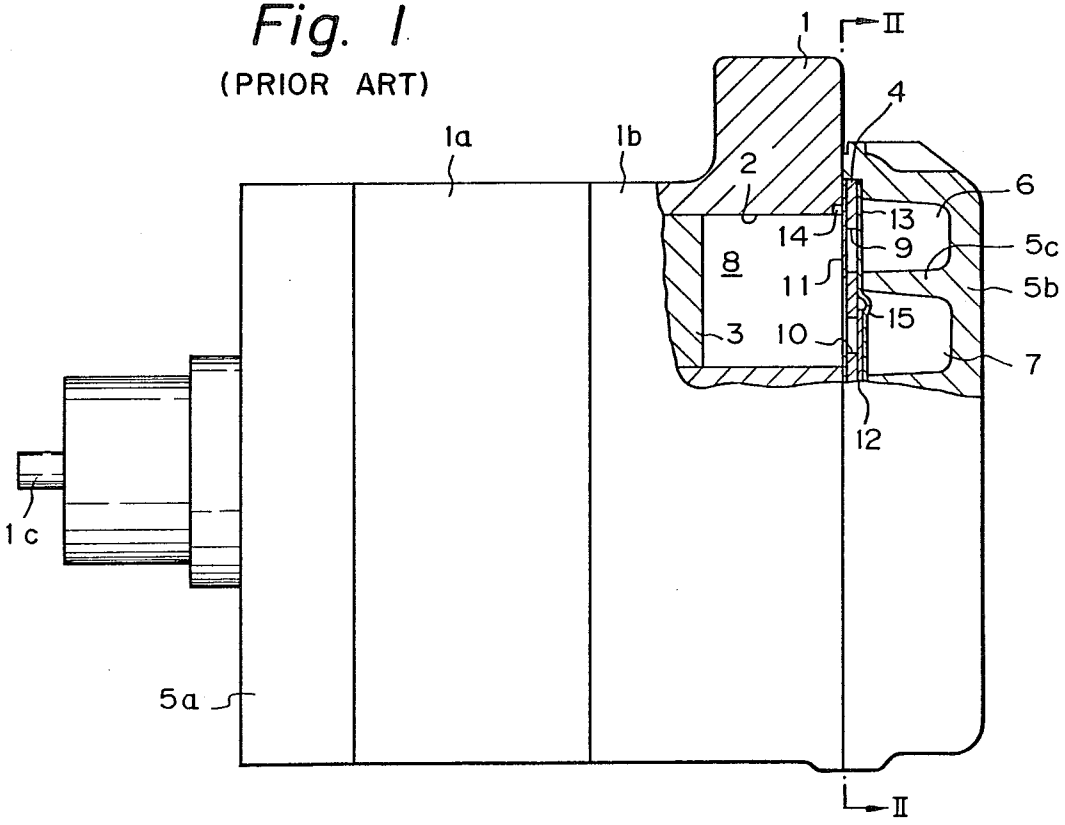
Fig. 1 (PRIOR ART)
FIG. 1 is a partly broken front view of a typical example of a swash plate-operated piston type compressor in which suction and discharge valve mechanisms, according to the present invention as well as the prior art can be equally accommodated.

Referring to FIG. 1, a swash plate-operated type compressor has a front and a rear cylinder block 1*a* and 1*b* combined together so as to form an integral cylinder block provided therein with a plurality of axial cylinder bores 2 arranged in parallel with a central axis of a drive shaft 1*c* on which a swash plate (not shown) is keyed. In the cylinder bores 2, double-acting pistons 3 are received so as to be reciprocated to compress a refrigerant gas returned from an outer air-conditioning circuit. The reciprocation of the piston 3 is caused by the rotation of the swash plate driven by the drive shaft 1*c*. An axial end of the front cylinder block 1*a* is closed by a front housing 5*a*, and an axial end of the rear cylinder block 1*b* is closed by a rear housing 5*b*. The front and rear housings 5*a* and 5*b* are connected to the corresponding axial ends of the cylinder blocks 1*a* and 1*b*, via valve plates (only the rear valve plate 4 is illustrated in FIG. 1). Each of the front and rear housings 5*a* and 5*b* includes therein a suction chamber for receiving a refrigerant gas to be compressed, and a discharge chamber for receiving a compressed refrigerant gas. Thus, the front side of the compressor assumes a half of the entire compression capacity and the rear side of the compressor assumes the remaining half.

FIG. 1 typically illustrates the inner construction of the rear side of the compressor. Note, a like construction is arranged in the front side of the compressor.

Figure 2:
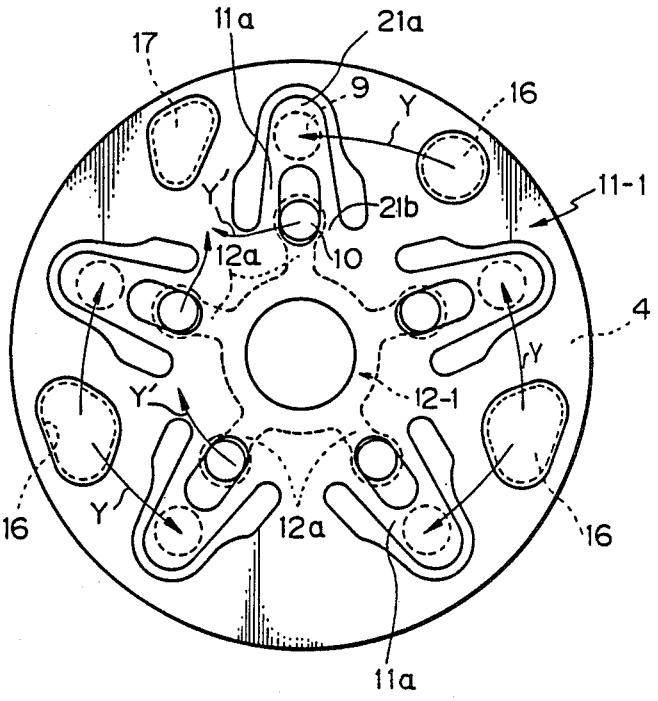
Fig. 2 (PRIOR ART)
FIG. 2 is a view taken along the line II—II of FIG. 1, illustrating the general arrangement of the suction and discharge valve mechanism of the prior art.

As illustrated in FIG. 1, the rear housing 5*b* forms therein a substantially annular suction chamber 6 and a substantially cylindrical discharge chamber 7, isolated from one another by a wall 5*c*. These suction and discharge chambers 6 and 7 are fluidly connectable to the outer air-conditioning circuit by means of suitable conduits. The valve plate 4 is formed with a plurality of suction ports for providing a fluid communication between the suction chamber 6 and the cylinder bores 2 serving as compression chambers, during the suction stroke of the pistons 3, and with a plurality of discharge ports 10 for providing a fluid communication between the discharge chamber 7 and the cylinder bores 2 during the discharge stroke of the piston 3. The valve plate 4 is also formed with a plurality of later-described inlet ports (not illustrated in FIG. 1) for permitting the refrigerant gas to flow into the suction chamber 6 when returned from the air-conditioning circuit, and at least one later-described outlet port (not illustrated in FIG. 1) for discharging the compressed refrigerant from the discharge chamber 7 toward the air-conditioning circuit. A suction valve disk 11 made of an elastic steel plate, such as a stainless steel plate 0.2 through 0.4 mm thick, is intervened between the axial end of the rear cylinder block 1*b* and an inner end face of the valve plate 4. A discharge valve disk 12 also made of an elastic steel plate, and a gasket 13 having later-described retainer portions 15, are intervened between an outer end face of the valve plate 4 and the rear cylinder block 5*b*. Referring to FIG. 2 illustrating the suction and discharge valve mechanisms of the prior art, the suction valve disk 11-1 of the prior art is formed with a plurality (five in this example) of radially extended suction reed valves 11*a* angularly located in positions corresponding to the above-mentioned suction ports 9. Each of the suction reed valves 11*a* has a free end 21*a* movable to an opening position whereat it abuts against a recessed valve stop 14 (FIG. 1) of the cylinder block 1*b*, and a substatial length extending from a base portion 21*b* toward the free end 21*a* along a diametrical direction of the corresponding cylinder bores 2. The suction valve disk 11-1 is also formed with a plurality of later-described elliptical openings, clearly illustrated in FIG. 2, in the base portion 21*b* so as to be in alignment with the discharge ports 10 of the valve plate 4, and a plurality of inlet openings for introducing a refrigerant gas to be compressed into the suction chamber 6 through the inlet ports 16 of the valve plate 4.

The discharge valve disk 12-1 of the prior art is formed with a plurality (five in this example) of radially extended discharge reed valves 12*a* angularly located in positions corresponding to the above-mentioned discharge ports 10. The movement of the discharge reed valves 12*a* from a closing position to close the discharge ports 10 to an opening position to open the ports 10 is limited by retainer portions 15 (FIG. 1) formed in the gasket 13. Formation of the suction and discharge valve disks 11-1 and 12-1 is achieved by a known press machine.

With the above-mentioned swash plate-operated piston type compressor of FIGS. 1 and 2, the refrigerant gas to be compressed flows into the suction chamber 6 of the rear housings 5b, via a swash plate chamber (not illustrated in FIGS. 1 and 2), suction passageways (not illustrated in FIGS. 1 and 2) formed between the angularly neighboring cylinder bores 2 of the front and rear cylinder blocks 1a and 1b, and inlet ports 16 of the valve plate 4. The refrigerant gas in the suction chamber 6 is then pumped into the cylinder bores 2 to be compressed, via the suction ports 9 when opened by the suction reed valves 11a. Arrows "Y" in FIG. 2 indicate the typical flows of the refrigerant gas from the inlet ports 16 toward the suction ports 9. On the other hand, the refrigerant gas compressed by the pistons 3 is expelled from the cylinder bores 2 into the discharge chamber 7 of the rear housing 5, via the discharge ports 10 when opened by the discharge reed valves 12a. Arrows "Y'" in FIG. 2 indicate the flows of the compressed refrigerant gas flowing from the discharge ports 10 toward the outlet port 17 within the discharge chamber 7 of the rear housing 5b. The compressed refrigerant gas subsequently passes through the discharge passageways in the rear cylinder block 1b and is then discharged to the outer air-conditioning circuit. The above-described suction and discharge of the refrigerant gas takes place similarly in the front side of the compressor.

At this stage, it should be noted that the movements of the suction and discharge reed valves 11a and 12a from the closing position to the opening position, and vice versa, occur in oscillatory motion manner, due to a pressure differential between the compression chambers of the cylinder bores 2 and the suction and discharge chambers 6 and 7 during the operation of the compressor, i.e., the rotation of the drive shaft 1c. Moreover, a change in the flow resistances of the suction and discharge refrigerant gas as well as a change in the amount of flow of the suction and discharge refrigerant gas have an adverse affect on the movements of the suction and discharge reed valves 11a and 12a of the suction and discharge reed valve disks 11-1 and 12-1. That is, FIGS. 3, 4A, and 4B diagrammatically illustrate irregular vibratory movements of the suction reed valve 11a of the suction valve disk 11-1.

Figure 3:
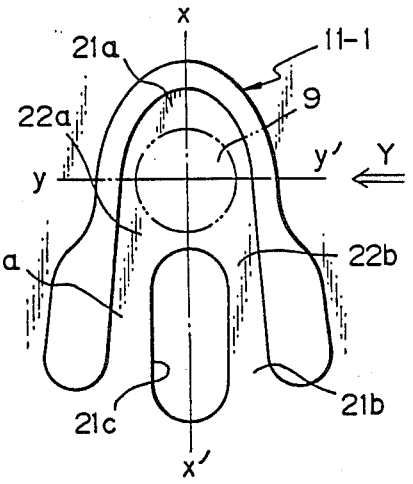
Fig. 3 (PRIOR ART)
FIG. 3 is a partial enlarged view of the suction valve mechanism of the prior art.
Figure 4A:
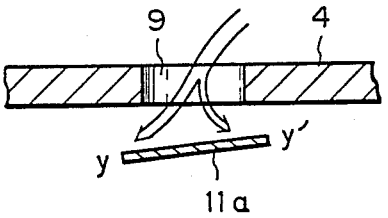
Fig. 4A (PRIOR ART)
FIGS. 4A and 4B are schematic cross-sectional views of the suction valve mechanism of the prior art, illustrating the unstable movement of the suction reed valve during the compressing operation of the piston type compressor.
Figure 4B:
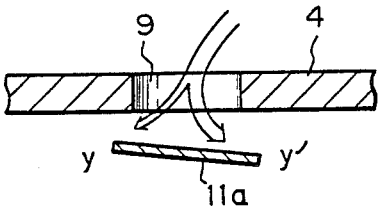
Fig. 4B (PRIOR ART)

As illustrated in FIG. 3, the suction reed valve 11a of the suction valve disk 11-1 is formed with an elliptical opening 21c at the base portion 21b, for permitting the compressed refrigerant gas to pass therethrough, and is formed so as to become narrower toward the free end 21a. The suction reed valve 11a has two symmetrical portions 22a and 22b with respect to a lengthwise central axis x-x' and is in register with the corresponding suction port 9 of the valve plate 4 (FIG. 1). An arrow "Y" in FIG. 3 corresponds to one of the arrows "Y" in FIG. 2, and indicates the flow of the refrigerant gas pumped into the suction port 9 along the line y-y' extending through the center of the suction port 9 and approximately perpendicular to the axis x-x'. Therefore, when the piston 3 carries out the suction stroke within the cylinder bore 2, the flow of the refrigerant gas is pumped into the cylinder bore 2 through the suction port 9 in response to the opening motion of the suction reed valve 11a while pressing the suction reed valve 11a toward the opening position. At that time, due to the symmetrical arrangement of the suction reed valve 11a per se, and the suction port 9 with respect to the central axis x-x', the movements of the two symmetrical portions 22a and 22b change in an irregular and unstable manner, as best illustrated in FIGS. 4A and 4B, no matter how small a change occurs in the flow characteristics of the refrigerant gas. The repetition of these irregular and unstable movements of the suction reed valve 11a appears as irregular vibrations of the suction reed valve 11a which are added to the regular oscillatory motions of the suction reed valve 11a. As a result, complicated vibratory movements of the suction reed valve 11a of the suction valve disk 11-1 take place, and are transmitted to an evaporator of the outer air-conditioning circuit as a complicated pulsation of the suction refrigerant gas, via a suction piping for conveying the refrigerant gas to be compressed. Similar complicated vibratory movements of the discharge reed valves 12a of the discharge valve disk 12-1 are transmitted to a gas condenser of the air-conditioning circuit as a complicated pulsation of the discharging refrigerant gas, via a discharge piping for conveying the compressed refrigerant. Consequently, the evaporator and the condenser of the air-conditioning circuit, which are liable to resonate with vibrations, produce noise. Particularly, in recent light weight cars, the car body per se resonantly produces noise which is perceived by a car passenger. In order to obviate such a noise problem, in a certain piston type compressor of the prior art, a muffling means having a size of 40 through 100 cubic centimeters is attached to the discharge end of the compressor. However, the attachment of the muffling means brings about diverse defects, such as a temperature rise, a high cost and an increase in the size of the compressor body.

The present invention provides improved suction and discharge valve mechanisms for a piston type compressor, as will be made apparent from the descriptions of the embodiments set forth below.

Figure 5A:
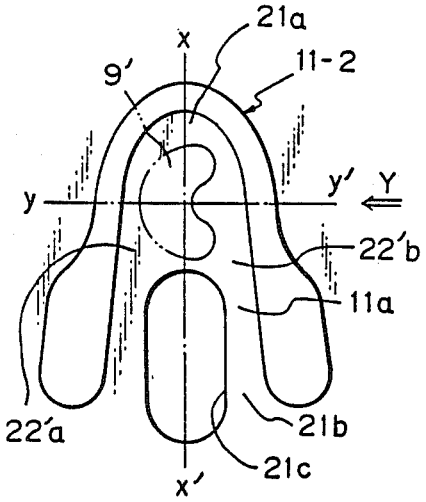
FIGS. 5A and 5B are partial enlarged views of suction and discharge valve mechanisms for the piston type compressor, according to a first embodiment of the present invention, respectively.
Figure 5B:
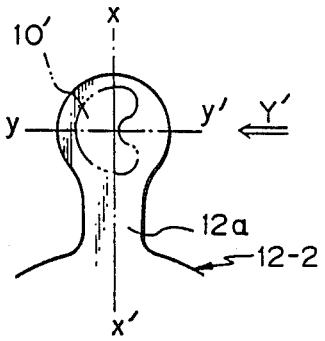

Referring to FIGS. 5A and 5B, which illustrate suction valve and discharge valve mechanisms of the first embodiment of the present invention, a suction valve disk 11-2 includes a plurality of suction reed valves 11a (one suction reed valve 11a is typically shown in FIG. 5A). The suction reed valve 11a is formed with an elliptical opening 21c at a base portion 21b for permitting the compressed refrigerant gas to pass therethrough, and is shaped so as to become narrower at a free end 21a. A discharge valve disk 12-2 includes a plurality of discharge reed valves 12a (one discharge reed valve 12a is typically shown in FIG. 5B) having a circular head for covering a corresponding discharge port 10' of the valve plate 4 (FIG. 1) and a planar neck portion. An arrow Y in FIG. 5A indicates the flow of the refrigerant gas directed toward a suction port 9' within the suction chamber 6 (FIG. 1). An arrow Y' in FIG. 5B indicates the flow of the refrigerant gas directed from the discharge port 10' toward the outlet port 17 (FIG. 2) within the discharge chamber 7. Lines y-y' in FIGS. 5A and 5B perpendicular to the central axis x-x' of the suction and discharge reed valves 11a and 12a, respectively, indicate the flowing directions of the refrigerant gas, respectively. The suction reed valve 11a has a first and a second symmetrical portions 22'a and 22'b with respect to the central axis x-x', and the discharge reed valve 12a has also a first and a second symmetrical portions 24a and 24b with respect to the central axis x-x'.

At this stage, according to the first embodiment of the present invention, the suction port 9' formed in the valve plate 4 has an asymmetrical shape with respect to the central axis x-x' of the suction reed valve 11a, but has a symmetrical shape with respect to the flowing direction y-y' of the refrigerant gas flow Y. Specifically, the opening area of the suction port 9' covered by the first portion 22'a of the suction reed valve 11a of the suction valve disk 11-2 is arranged to be larger than that covered by the second portion 22'b of the same suction reed valve 11a.

Similarly, the discharge port 10' formed in the valve plate 4 has an asymmetrical shape with respect to the central axis x-x' of the discharge reed valve 11a, but has a symmetrical shape with respect to the flowing direction y-y' of the refrigerant gas flow Y'.

The opening area of the discharge port 10' covered by the first portion 24a of the discharge reed valve 12a of the discharge valve disk 12-2 is arranged to be larger than that covered by the second portion 24b of the same discharge reed valve 12a.

Figure 6A:
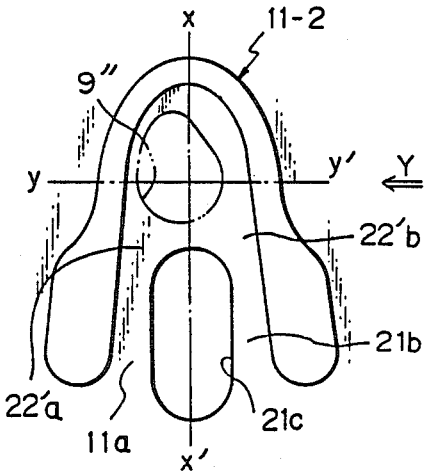
FIGS. 6A and 6B are partial enlarged views of suction and discharge valve mechanisms for the piston type compressor, according to a modification of the embodiment of FIGS. 5A and 5B, respectively.
Figure 6B:
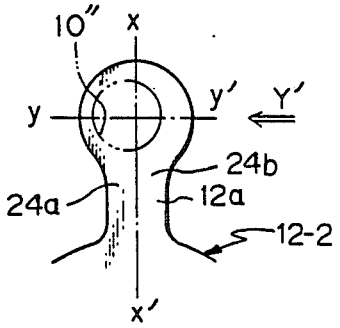

The shapes of the suction port 9' and the discharge port 10' may be modified to a suction port 9" and a discharge port 10" as shown in FIGS. 6A and 6B, respectively. The suction port 9" and the discharge port 10" are formed so as to be asymmetrical with respect to both the central axis x-x' of the valves 11a and 12a and the flowing direction y-y' of the refrigerant gas flows Y and Y', illustrated in FIGS. 6A and 6B.

Figure 7:
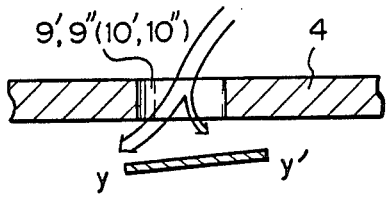
FIG. 7 is a schematic cross-sectional view of a suction and a discharge reed valves employed in the suction and discharge valve mechanisms of the embodiment of FIGS. 5A and 5B or the modification of FIGS. 6A and 6B, illustrating the stable movement of the reed valves.

In accordance with the above-mentioned asymmetrical arrangement of the suction port 9' or 9" of the valve plate 4, the first and second symmetrical planar portions 22'a and 22'b of the suction reed valve 11a are always subjected to refrigerant gas pressures different from one another during the operation of the piston type compressor, i.e., the pumping (suction ) stroke of the pistons 3 (FIG. 1). Accordingly, when the suction reed valve 11a is bent and moved from the closed position thereof to the opening position with respect to the refrigerant gas flow Y, the displacement of the first planar portion 22'a always tends to be larger than that of the second planar portion 22'b as illustrated in FIG. 7. That is, the movement of the suction reed valve 11a of the suction valve disk 11-2 can be constant and regular so as to arrive at a constant open position, although slightly inclined as shown in FIG. 7.

The asymmetrical arrangement of the discharge port 10' or 10" of the valve plate 4 similarly brings about a constant and regular difference in the displacements of the first and second symmetrical planar portions 24a and 24b of the discharge reed valve 12a. as also shown in FIG. 7.

The above-described constant movements of the suction and discharge reed valves 11a and 12a contribute to preventing the occurrence of complicated and irregular vibrations of the suction and discharge reed valves 11a and 12a per se. That is, the movements of the suction and discharge reed valves 11a and 12a can be always regular oscillatory movements between the closing positions in contact with the valve plate 4 and the opening positions abutting against the valve stops 14 and 15. Consequently, the pulsations in the suction and discharge flows of the refrigerant gas caused by the suction and discharge valve mechanisms of the piston type compressor are effectively suppressed to the lowest level. Therefore, the level of noie produced by the evaporator and the gas condenser can be lowered. This also makes it possible to avoid the employment of a muffling means for noise suppression. As a result, a rise in the temperature of the compressed refrigerant gas, as well as an increase in the size of the piston type compressor per se, can be prevented.

Figure 8A:
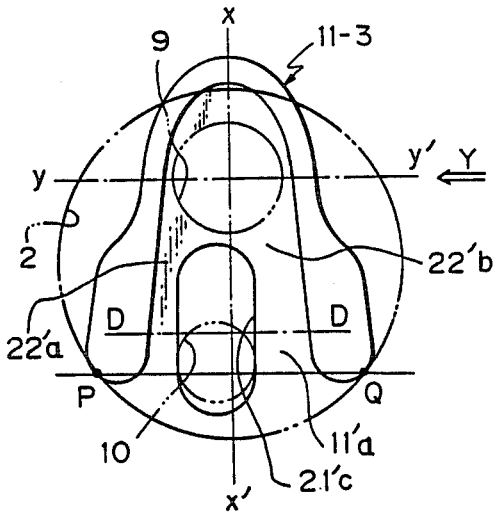
FIGS. 8A and 8B are partial enlarged views of suction and discharge valve mechanisms for the piston type compressor, according to a second embodiment of the present invention, respectively.
Figure 8B:
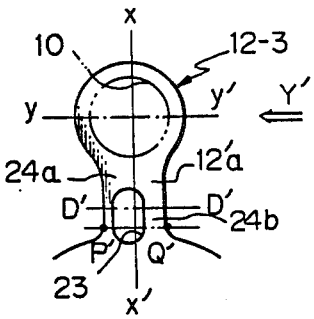

FIGS. 8A and 8B illustrate the suction valve mechanism and discharge valve mechanism adapted for a piston type compressor according to the second embodiment of the present invention, respectively.

Figure 9:
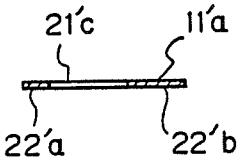
FIG. 9 is a cross-sectional view taken along the line D-D of FIG. 8A or 8B; and, FIG. 10 is a schematic cross-sectional view of suction and a discharge reed valves employed in the suction and discharge valve mechanisms of the embodiment of FIGS. 8A and 8B.
Figure 10:
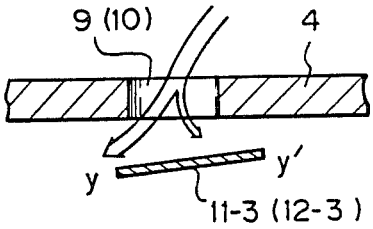

Referring first to FIG. 8A, a suction valve disk 11-3 includes a plurality of suction reed valves ll'a (one of the valves 11'a is shown in FIG. 8A). The suction reed valve 11'a has a first planar portion 22'a and a second planar portion 22'b which are symmetrical with one another with respect to the central axis x-x' of the valve 11'a. The above-mentioned first and second portions 22'a and 22'b extend from a base portion 21b toward a free end portion 21a along the central axis x-x'. The base portion of the suction reed valve 11'a is formed with an elliptical opening 21'c arranged to be approximately in register with the discharge port 10 of the valve plate 4 (FIG. 1). This elliptical opening 21'c is provided not only for permitting the compressed refrigerant gas to pass therethrough from the compression chamber of the cylinder bore 2 into the discharge chamber 7 (FIG. 1) but also for adjusting the bending flexibility of the suction reed valve 11'a with regard to a line passing through points P and Q where the base portion 21b of the suction reed valve 11'a bears against the edge of the corresponding cylinder bore 2, as will be understood from FIG. 8A. At this stage, it should be noted that the elliptical opening 21'c is not located at the center of the first and second planar portions 22'a and 22'b but is displaced from the central axis x-x' toward the first planar portion 22'a. As a result, a cross sectional area of the first planar portion 22'a, taken along a line D-D parallel with the line P-Q, is larger than and asymmetrical with that of the second planar portion 22'b as illustrated in FIG. 9. Accordingly, the bending flexibility of the first planar portion 22'a with respect to the line D-D is larger than that of the second planar portion 22'b with respect to the same line D-D. Therefore, when the suction refrigerant gas Y flows from the suction chamber 6 (FIG. 1) into the cylinder bore 2 through the suction port 9, due to the opening of the suction reed valve 11'a, respective displacements of the first and second planar portions 22'a and 22'b of the suction reed valve 11'a from the closed position in contact with the valve plate 4 toward the open position are different from one another, as schematically illustrated in FIG. 10. That is, the first planar portion 22'a having a larger bending flexibility constantly and regularly exhibits a larger displacement than the second planar portion 22'b during the opening movement of the suction reed valve 11'a. Consequently, the movements of the plurality of suction reed valves 11'a of the suction valve disk 11-3 do not involve complicated and irregular vibrating motions, and can always be stable and regular without causing complicated pulsation in the flow of the suction refrigerant gas. Therefore, noise produced by the evaporator of the air-conditioning circuit, due to the complicated and irregular vibrations of the suction valve mechanism, can be suppressed to the lowest level.

Referring to FIG. 8B, a discharge valve disk 12-3 of the discharge valve mechanism includes a plurality of discharge reed valves 12'a (one of the discharge reed valve 12'a is typically shown in FIG. 8B). The discharge valve 12'a has a generally circular head portion capable of openably closing a discharge port 10 of the valve plate 4 (FIG. 1) and a narrow neck portion along the central axis x-x' of the valve 12'a. Further, the discharge reed valve 12'a has a first planar portion 24a and a second planar portion 24b symmetrical with one another with respect to the central axis x-x'. The narrow neck portion of the discharge valve 12'a is formed with an elliptical opening 23 for adjusting bending flexibility of the discharge reed valve 11'a with regard to a line passing through points P' and Q' where the neck portion of the discharge reed valve 12'a bears against the edge of the corresponding retainer portion 15 of the gasket 13 (FIG. 1). That elliptical opening 23 of the neck portion of the discharge valve 12'a is not located at the center of the first and second planar portions 24a and 24b and is displaced from the central axis x-x' toward the first planar portion 24a. As a result, a cross sectional area of the first planar portion 24a, taken along a line D'-D' parallel with the line P'-Q', is larger than and asymmetrical with that of the second planar portion 24b, as will be understood from FIG. 8B. That is to say, the elliptical opening 23 is provided for the same purpose as the elliptical opening 21'c of the suction reed valve 11'a. Therefore, the movements of the plurality of discharge reed valves 12'a of the discharge valve disk 12-3 do not involve complicated and irregular vibrating motions, and can be always stable and regular without causing complicated pulsations in the flow of the compressed refrigerant gas. Accordingly, noise produced by the gas condenser of the air-conditioning circuit, due to the complicated and irregular vibrations of the discharge valve mechanism, can be suppressed to the lowest level, by the same principle as in the case of the suction reed valves ll'a of the suction valve mechanism illustrated in FIGS. 8A, 9, and 10. Arrow Y' designates the flow of the compressed refrigerant gas directed from the compression chamber of the cylinder bore 2 (FIG. 1).

It will easily occur to persons skilled in the art that the suction reed valves 11'a and the discharge reed valve 12'a of FIGS. 8A and 8B may be implemented individually or in combination in the application to the suction and discharge mechanisms for a piston type compressor.

From the foregoing description of the preferred embodiments of the present invention, it will be understood that, according to the present invention, the piston type compressor, such as a swash plate type compressor and a wobble plate type compressor, can operate without complicated and irregular vibrations of the suction and discharge valve mechanisms. Therefore, it is possible to suppress the noise level of the elements liable to resonate with mechanical vibrations, such as an evaporator and a gas condenser of the air-conditioning circuit, to the lowest level.

We claim:

1. A piston type compressor comprising:

a cylinder block having therein a plurality of axial cylinder bores formed as compression chambers for permitting therein pistons to be reciprocated to compress a refrigerant gas;

at least a housing closing an axial end of the cylinder block for forming a suction chamer receiving therein a refrigerant gas to be compressed and a discharge chamber for receiving a compressed refrigerant gas;

a valve plate having an inlet port for introducing the refrigerant gas to be compressed from an outer air-conditioning circuit into the suction chamber, suction ports for fluidly communicating between the suction chamber and the compression chambers, an outlet port for discharging the compressed refrigerant gas from the discharging chamber toward the outer air-conditioning circuit, and discharge ports for fluidly communicating between the discharge chamber and the compression chambers;

suction valve means arranged on one end face of the valve plate and having a plurality of suction reed valves adapted to perform an oscillatory movement between a closing position being in contact with the valve plate for closing a corresponding one of said suction ports and an opening position apart from the valve plate for opening the corresponding suction port in response to a reciprocating motion of the pistons, each suction reed valve having a substantial length to define a first and second symmetrical planar portion on each side of a lengthwise central axis thereof;

discharge valve means arranged on the other end face of the valve plate and having a plurality of discharge reed valves adapted to perform an oscillatory movement between a closing position being in contact with the valve plate for closing a corresponding one of said discharge ports and an opening position apart from the valve plate for opening the corresponding discharge port in response to a reciprocating motion of the pistons, each discharge reed valve having a substantial length to define a first and second symmetrical planar portion on each side of a lengthwise central axis thereof; and wherein each of the suction ports of the valve plate has a first portion to be closed by the first planar portion of a corresponding one of the suction reed valves and a second portion to be closed by the second planar portion of the corresponding one of the suction reed valves, the first and second portions of each suction port being arranged to be asymmetrical with one another with respect to the lengthwise central axis of the corresponding suction reed valves so as to cause a predetermined planar portion of each of the planar suction valves to achieve a larger displacement from a closed position in contact with the valve plate upon each movement toward the open position.

2. A piston type compressor according to claim 1, wherein said first portion of said each of said suction ports of said valve plate has an opening area larger then that of said second portion of said each of said suction ports.

3. A piston type compressor according to claim 2, wherein said first and second portions of said each suction port of said valve plate have a common axis perpendicular to said lengthwise central axis of said corresponding suction reed valve, and are arranged to be symmetrical with respect to said common axis, respectively.

4. A piston type compressor of claim 1, wherein each of said discharge ports of said valve plate has a first portion to be closed by said first planar portion of a corresponding one of said discharge reed valves and a second portion to be closed by said second planar portion of the corresponding one of said discharge reed valves, said first and second portions of said each discharge port being arranged asymmetrical to one another with respect to said lengthwise central axis of said corresponding one of said discharge reed valves so as to form a means for subjecting a predetermined one of said first and second planar portions of each of said plurality of discharge reed valves to a larger displacement from the closing position in contact with the valve plate upon each movement toward the opening position.

5. A piston type compressor according to claim 4, wherein said first portion of said each of said discharge ports of said valve plate has an opening area larger than that of said second portion of said each of said discharge ports.

6. A piston type compressor according to claim 5, wherein said first and second portions of said each discharge port of said valve plate have a common axis perpendiculr to said lengthwise central axis of said corresponding discharge reed valve, and are arranged to be symmetrical with respect to said common axis, respectively.

7. A piston type compressor comprising:

a cylinder block having therein a plurality of axial cylinder bores formed as compression chambers for permitting therein pistons to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate having an inlet port for introducing the refrigerant gas to be compressed from an outer air-conditioning circuit into the suction chamber, suction ports for fluidly communicating between the suction chamber and the compression chambers, an outlet port for discharging the compressed refrigerant gas from the discharging chamber toward the outer air-conditioning circuit, and discharge ports for fluidly communicating between the discharge chamber and the compression chambers;

suction valve means arranged on one end face of the valve plate and having a plurality of suction reed valves adapted to perform an oscillatory movement between a closing position being in contact with the valve plate for closing a corresponding one of said suction ports and an open position apart from the valve plate for opening the corresponding suction port in response to a reciprocating motion of the pistons, each suction reed valve having a substantial length to define a first and second planar portion on each side of a lengthwise central axis thereof;

discharge valve means arranged on the other end face of the valve plate and having a plurality of discharge reed valves adapted to perform an oscillatory movement between a closing position being in contact with the valve plate for closing a corresponding one of said discharge ports and an opening position apart from the valve plate for opening the corresponding discharge port in response to a reciprocating motion of the pistons, each discharge reed valve having a substantial length to define a first and second symmetrical planar portion of each side of a lengthwise central axis thereof; and wherein each of said suction reed valves of said suction valve means has a free end portion and a base portion apart from one another along said lengthwise central axis of said each suction reed valve, and wherein said base portion of said each suction reed valve is formed with a through-opening having a first portion located at said first planar portion of said each suction reed valve and a second portion located at said second planar portion of said each suction reed valve, said first and second portions of said through-opening being asymmetrical with one another with respect to said lengthwise central axis of said each suction reed valve, thereby forming a means for subjecting a predetermined one of said first and second planar portions of each of said plurality of suction reed valves to a larger displacement from said closing position in contact with said valve plate upon each movement toward said opening position.

8. A piston type compressor according to claim 7, wherein said first portion of said through-opening of said each suction reed valve has an opening area larger than that of said second portion of said through-opening of said each suction reed valve.

9. A piston type compressor according to claim 7, wherein each of said discharge reed valves of said discharge valve means has a circular head portion capable of covering a corresponding one of said discharge ports of said valve plate and a neck portion, and wherein said neck portion of said each discharge reed valve is formed with a through-opening having a first portion located at said first planar portion of said each discharge reed valve and a second portion located at said second planar portion of said each discharge reed valve, said first and second portions of said through-opening being asymmetrical with one another with respect to said lengthwise central axis of said each discharge reed valve, thereby forming a means for subjecting a predetermined one of said first and second planar portions of each of said plurality of discharge reed valves to a larger displacement from said closing position in contact with said valve plate upon each movement toward said opening position.

10. A piston type compressor according to claim 9, wherein said first portion of said through-opening of said each discharge reed valve has an opening area larger than that of said second portion of said though-opening of said each discharge reed valve.

11. A piston type compressor comprising: a cylinder block having therein a plurality of axial cylinder bores formed as compression chamber for permitting therein pistons to be reciprocated to compress a refrigerant gas;

at least a housing closing an axial end of the cylinder block for forming a suction chamber receiving therein a refrigerant gas to be compressed and a discharge chamber for receiving a compressed refrigerant gas;

a valve plate having an inlet port for introducing the refrigerant gas to be compressed from an outer air-conditioning circuit into the suction chamber, suction ports for fluidly communicating between the suction chamber and the compression chambers, an outlet port for discharging the compressed refrigerant gas from the discharging chamber toward the outer air-conditioning circuit, and discharge ports for fluidly communicating between the discharge chamber and the compression chambers;

suction valve means arragned on one end face of the valve plate and having a plurality of suction reed valves adapted to perform an oscillatory movement between a closing position being in contact with the valve plate for closing a corresponding one of a said suction ports and an opening position apart from the valve plate for opening the corresponding suction port in response to a reciprocating motion of the pistons, each suction reed valve having a substantial length to define a first and second symmetrical planar portion on each side of a lengthwise central axis thereof;

discharge valve means arranged on the other end face of the valve plate and having a plurality of discharge reed valves adapted to perform an oscillatory movement between a closing position being in contact with the valve plate or closing a corresponding one of said discharge ports and an opening position apart from the valve plate for opening the corresponding discharge port in response to a reciprocating motion of the pistons, each discharge reed valve having a substantial length to define a first and second symmetrical planar portion on each side of a lengthwise central axis thereof; wherein each of the suction ports of the valve plate has a first portion to be closed by the first planar portion of a corresponding one of the suction reed valves and a second portion to be closed by the second planar portion of the corresponding one of the suction reed valves, the first and second portions of each suction port being arranged to be asymmetrical with one another with respect to the lengthwise central axis of the corresponding suction reed valves so as to cause a predetermined planar portion of each of the planar suction valves to achieve a larger displacement from a closed position in contact with the valve plate upon each movement toward the open position; and wherein each of said discharge ports of said valve plate has a first portion to be closed by said first planar portion of a corresponding one of said discharge reed valves and a second portion to be closed by said second planar portion of the corresponding one of said discharge reed valves, said first and second portions of said each discharge port being arranged to be asymmetrical with one another with respect to said lengthwise central axis of said corresponding one of said discharge reed valves so as to subject a predetermined one of said first and second planar portions of each of said plurality of discharge reed valves to a larger displacement from a closed position in contact with the valve plate upon each movement toward the open position.

* * * * *